US005614021A

United States Patent [19]

Catlin

[11] Patent Number: 5,614,021

[45] Date of Patent: Mar. 25, 1997

[54] PAINT ROLLER WITH INTEGRAL WASHER ASSEMBLY

[76] Inventor: Fred C. Catlin, 1208 S. 58th St., Tampa, Fla. 33619

[21] Appl. No.: 593,594

[22] Filed: Jan. 29, 1996

Related U.S. Application Data

[63] Continuation of Ser. No. 301,196, Sep. 6, 1994, abandoned.

[51] Int. Cl.[6] ..... B05C 1/00

[52] U.S. Cl. ..... 118/258; 118/264; 15/230.11; 15/248.2; 134/138; 134/183; 134/900; 401/219

[58] Field of Search ..... 134/900, 138, 134/183, 182; 68/213; 118/258, 264; 239/567; 15/230.11, 248.2; 401/219, 208

[56] References Cited

U.S. PATENT DOCUMENTS

| | | | |
|---|---|---|---|
| 2,938,368 | 5/1960 | Bixel | 134/900 |
| 3,049,746 | 8/1962 | Rachal | 401/219 |
| 3,310,831 | 3/1967 | Brinker | 401/219 |
| 3,422,828 | 1/1969 | Dommer | 134/138 |
| 3,441,355 | 4/1969 | Brown | 401/208 |
| 3,850,532 | 11/1974 | Kaiser | 401/219 |
| 3,873,364 | 3/1975 | Smith | 134/138 |
| 4,108,189 | 8/1978 | Claiborne et al. | 134/138 |
| 4,150,904 | 4/1979 | Stewart | 401/219 |
| 4,549,562 | 10/1985 | Ossi | 134/138 |
| 4,566,816 | 1/1986 | Janssen | 401/208 |
| 4,569,099 | 2/1986 | Harding | 15/248.2 |
| 4,593,428 | 6/1986 | Calvert | 15/248.2 |
| 4,709,717 | 12/1987 | Rannigan et al. | 239/567 |
| 4,765,353 | 8/1988 | Rhoades | 134/138 |
| 5,095,928 | 3/1992 | Phipps | 134/138 |
| 5,238,012 | 8/1993 | Coronato | 134/140 |

FOREIGN PATENT DOCUMENTS

| | | | |
|---|---|---|---|
| 897309 | 4/1980 | U.S.S.R. | 401/219 |

*Primary Examiner*—Laura Edwards
*Attorney, Agent, or Firm*—Dominik & Stein

[57] ABSTRACT

A paint roller assembly having an integral paint roller sleeve washing apparatus for washing a paint roller sleeve without having to remove the sleeve from the paint roller assembly. The paint roller assembly comprises a shield, a manifold connected to the shield and a plurality of tubes. The paint roller shield has a plurality of apertures therethrough. One end of each tube is connected in fluid flow communication to a corresponding one of the apertures and the other end of each tube is connected in fluid flow communication to the manifold. The manifold is connected in fluid flow communication to a fluid source whereby a fluid is sprayed on the sleeve rotating the sleeve and flushing the paint therefrom.

4 Claims, 2 Drawing Sheets

PAINT ROLLER WITH INTEGRAL WASHER ASSEMBLY

This is a continuation of patent application Ser. No. 08/301,196 filed on Sep. 6, 1994, now abandoned.

BACKGROUND OF THE INVENTION

1. Field of the Invention

This invention relates to paint rollers, and more particularly to paint rollers having an integral assembly for washing the paint roller and the paint roller sleeve. The invention is particularly applicable for use with paints having a water base.

2. Description of the Prior Art

Many different devices and methods have been developed to clean paint roller sleeves that have been used to apply water soluble paints. These devices range from the relatively simple shield disclosed by U.S. Pat. No. 4,569,099, issued to Harding, to more complex cleaning apparatus, such as that disclosed by U.S. Pat. No. 5,238,012, issued to Coronato. The Harding device discloses a shield that is attachable to an existing roller to control the overspray while a stream of water is applied to the roller for cleaning purposes. Most paint roller sleeve cleaning devices are constructed so that a stream of water strikes the sleeve obliquely so that the sleeve is rotated by the force of the water striking it. The stream of water then dilutes the paint residing on the roller and the centrifugal force assists the removal of the diluted paint from the roller. The differences between these patents generally relate to the method for housing the rollers and/or the method for applying the cleaning water to the sleeve.

The cleaning systems disclosed by Coronato, U.S. Pat. No. 5,238,012 and Smith, U.S. Pat. No. 3,873,364 each have moving parts and require removal of the sleeve from the paint roller while it is still loaded with paint. U.S. Pat. No. 5,095,928 issued to Phipps and U.S. Pat. No. 3,422,828 issued to Dommer both illustrate devices that receive the paint roller, while the sleeve that is to be cleaned is still mounted on the paint roller. Each device is relatively complex and expensive to make and maintain. They also require a cleaning apparatus that is separate from the existing paint roller.

U.S. Pat. No. 4,765,353 issued to Rhoades discloses a paint roller with an integral cleaning system. This device comprises a rotating shield and a manifold having a long longitudinal slot, approximately the same length as the roller, through which water flows for cleaning purposes. A similar paint roller guard assembly disclosed by Calvert, U.S. Pat. No. 4,593,428, also has a single linear slot for application of the water to the roller.

U.S. Pat. No. 4,108,189 issued to Claiborne et al. discloses a simple device in which water is sprayed on the roller from the handle of the paint roller device. This device has no shield and relies on an uncontrolled spray through a longitudinal slot to apply water in the general direction of the paint roller sleeve.

Notwithstanding the existence of such prior art paint roller cleaners, it remains clear that there is a need for a simple, inexpensive paint roller that has an integral means for cleaning the paint roller sleeve without requiring that the sleeve be removed from the paint roller prior to cleaning the sleeve. This device should also provide accurate control of the flow of water to ensure that the water is directed effectively upon the paint roller sleeve.

SUMMARY OF THE INVENTION

The present invention relates to a paint roller that has an integral means for cleaning paint roller sleeves while the sleeves are operatively attached to the paint roller. The invention comprises a shield having an arcuate side wall, first and second opposing end walls to which a paint roller sleeve may be attached, and a plurality of apertures through the shield. A manifold is connected to the shield so that the manifold is in fluid flow communication with the apertures in the shield. The manifold is also connected in fluid flow communication with a fluid source.

Each first end of each tube of a plurality of tubes is attached in fluid flow communication to the manifold and each second end of each tube is attached in fluid flow communication with a respective one of the plurality of apertures in the shield. The apertures are arranged generally linearly and longitudinally along the arcuate portion of the shield so that water passing through the apertures strikes the sleeve, mounted in the paint roller, along the longitudinal length of the sleeve. Each aperture has a longitudinal axis passing therethrough that coincides with the longitudinal axis of the resulting spray passing through the aperture. The spray strikes the sleeve obliquely, that is, the longitudinal axis of the spray is offset from the longitudinal axis of the roller so that the plurality of streams of water striking the sleeve cause the sleeve to rotate. The paint on the sleeve is diluted by the water and the centrifugal force created by the rotation of the sleeve ejects the paint and water solution from the sleeve cleaning the sleeve for future reuse.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1:
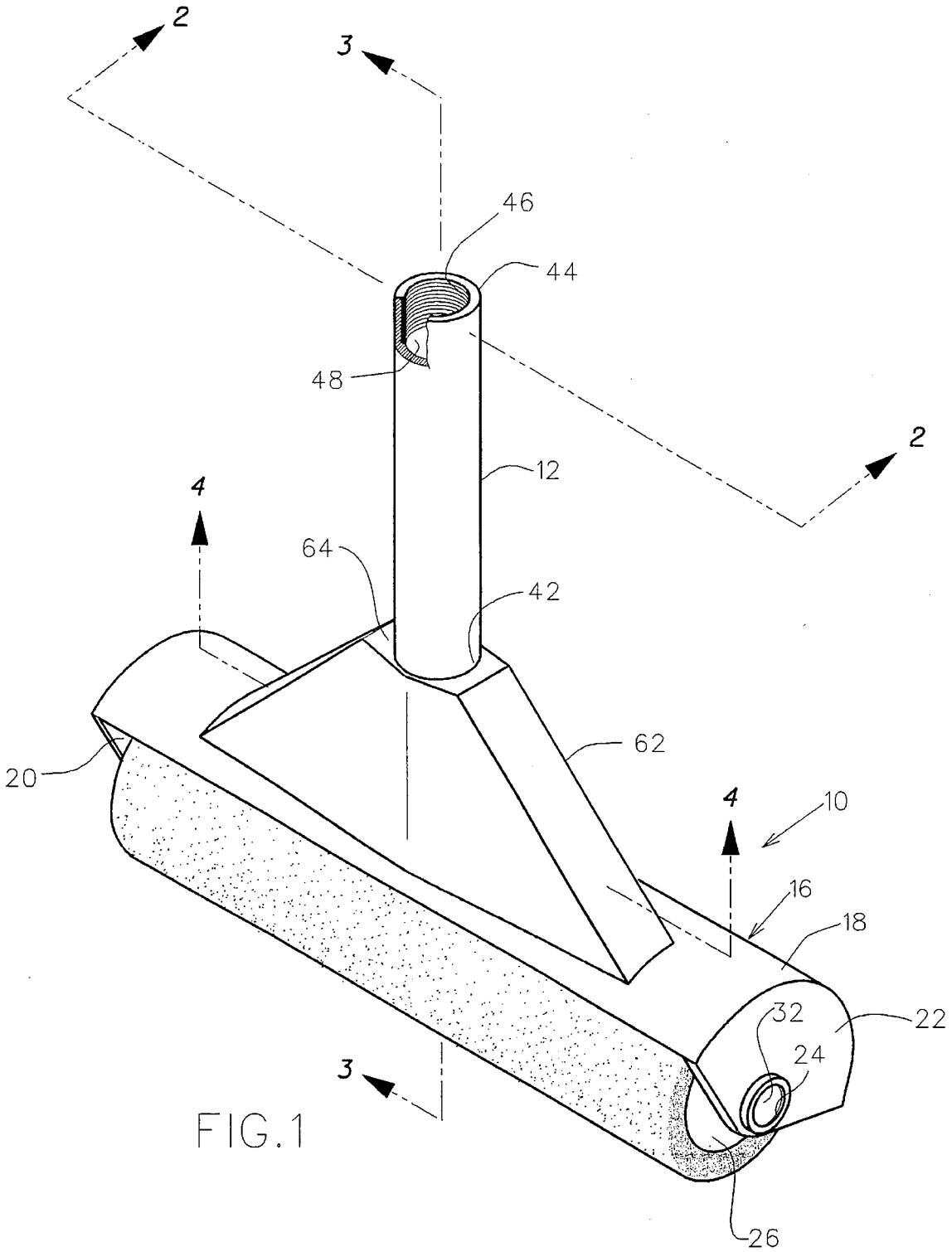
FIG. 1 is a perspective view of the invention with a portion of the handle broken away for clarity.
Figure 2:
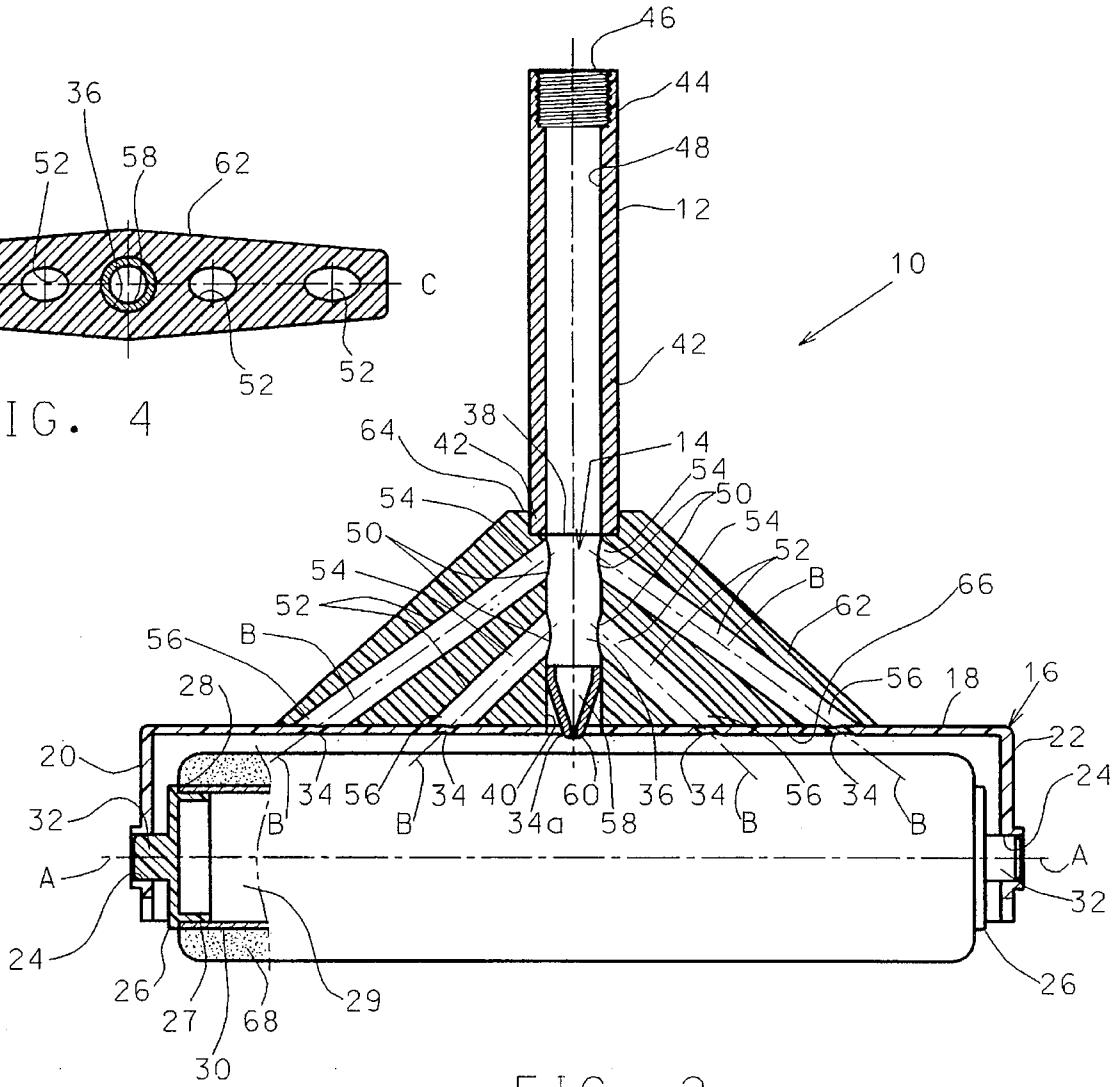
FIG. 2 is a partial sectional front elevational view of the invention of FIG. 1 taken along line 2—2 of FIG. 1.

A preferred embodiment, for the paint roller with integral washer assembly, of this invention is illustrated in the drawing FIGS. 1–4 in which the paint roller assembly is designated generally as 10. In FIGS. 1 and 2, it can be seen that the paint roller assembly 10 comprises a handle 12, a manifold generally designated as 14 and a shield generally designated as 16.

Figure 3:
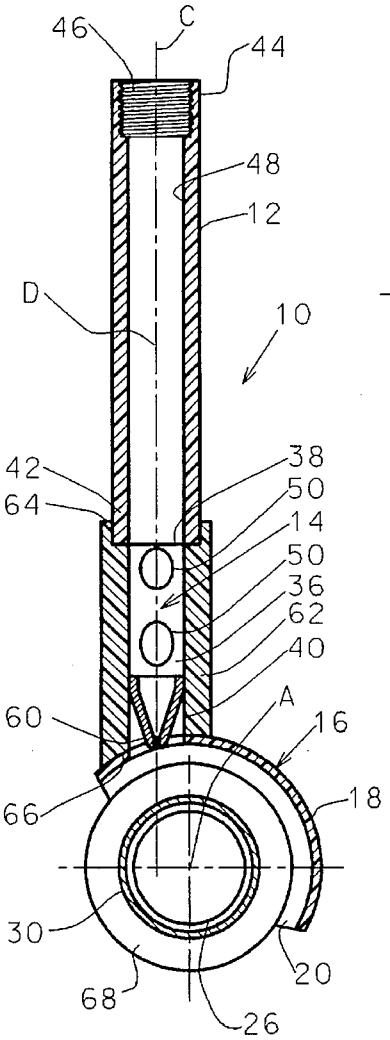
FIG. 3 is a sectional end elevational view taken along line 3—3 of FIG. 1.

As best seen in FIG. 1 the shield 16 comprises an arcuate side wall 18, a first end wall 20 and a second opposing end wall 22. End walls 20 and 22 each have a hole 24 therethrough. The holes 24 are spaced generally equi-distant from the arcuate side wall 18, as seen in FIG. 3. As seen in FIG. 2, a pair of end caps 26 are mountable within a paint roller sleeve 30. Each end cap 26 has a shaft 32 extending outwardly from the end cap 26 and thus outwardly from the sleeve 30 when the end caps 26 are mounted on the sleeve 30. Each shaft 32 is received in a corresponding hole 24 in the shield 16 so that the sleeve 30 is mounted for rotation within the curve of the arcuate side wall 18. A longitudinal axis A extends through the shafts 32 and the sleeve 30. The shield 16 has a plurality of apertures 34 therethrough that are spaced along a line that is generally parallel to the axis A of the sleeve 30, as can be seen in FIGS. 2 and 3.

Each end cap 26 has a cylindrical portion 27 that is received within sleeve 30 and a shoulder 28 that engages the sleeve 30 to prevent the end caps 26 from passing into the hollow portion 29 of the sleeve 30. Such end caps are well known in the art and may be of any convenient configuration as long as the shafts 32 are received by the holes 24 for free rotation therein.

As shown in FIGS. 2 and 3, in a preferred embodiment of the paint roller assembly 10, the manifold 14 is attached to the shield 16. The manifold 14 comprises a pipe 36 having an open first end 38 and an open second end 40. The second end 40 is attached to the shield 16 so that the open end 40 is in fluid flow communication with the aperture 34*a* that is located generally at the mid-point of the shield 16 between the first end 20 and the second end 22. A means for connecting the manifold 14 to a fluid (usually water) source is attached to first end 38 of the manifold 14. In a preferred embodiment illustrated in FIGS. 2 and 3, the first end 38 is attached in fluid flow communication with the first end 42 of the hollow handle 12. Threads 46 are formed on the interior surface 48 of the hollow handle 12, adjacent to the second end 44 of the handle 12, for threadable attachment to a water source, for example to a common garden hose (not shown). The manifold 14 further comprises a plurality of ports 50 formed therethrough. In other embodiments the first end 38 of the pipe 36 may be threaded for threadable connection to a water source, for example to a garden hose (not shown). The handle 12 may then be separately attached to the shield 16 instead of to the manifold 14.

The paint roller assembly 10 further comprises a plurality of tubes 52. Each tube 52 having a first end 54 that is attached in fluid flow communication with a corresponding port 50 and a second end 56 that is attached in fluid flow communication with a corresponding aperture 34. The diameter of the apertures 34 are generally equal to or smaller than the diameter of the tube. A nozzle 58 is inserted in the second end 40 of the pipe 36 so that the first end 60 of the nozzle 58 is received in aperture 34*a*, which has a larger opening than the other apertures 34.

Each aperture 34 has a longitudinal axis B extending therethrough. The axis B of at least one aperture 34 is spaced apart from the longitudinal axis A of the sleeve so that a stream of water extending along the axis B strikes the sleeve causing it to rotate. When axis B is spaced apart from axis A it does not intersect axis A. In a preferred embodiment, the longitudinal axis D and the longitudinal axis B of each aperture 34 define a plane C that is parallel to axis A, as seen in the cross sectional plane of FIG. 2 and in plane C of FIG. 3. Plane C is spaced apart from the axis A so that the center portion of the flow of water being ejected through the nozzle 58 and each of the apertures 34 strikes the sleeve obliquely thereby applying a rotational force to the sleeve 30.

Figure 4:
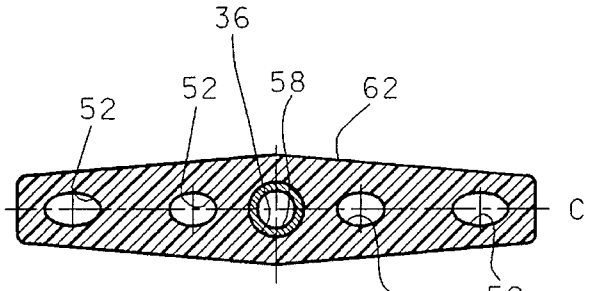
FIG. 4 is a sectional bottom plan view taken along line 4—4 of FIG. 1.

In the preferred embodiment disclosed in FIGS. 1–4 the manifold 14 and the tubes 52 are integrally formed in a distribution member 62 as shown in FIG. 2 and as shown in cross-section in FIG. 4. In other embodiments, the tubes 52 may be separate from one another. The thickness of the distribution member 62 may be varied to conserve materials and provide as light a paint roller as possible while ensuring adequate thickness to provide the necessary strength. The distribution member 62 has a trapezoidal configuration with the shorter side 64 of the parallel sides being attached to the handle 12. The longer side 66 of the parallel sides is attached to the shield 16.

Having thus set forth a preferred construction for the paint roller assembly 10 of this invention, it is to be remembered that this is but a preferred embodiment. Attention is now invited to a description of the use of the paint roller assembly 10. An end cap 26 is inserted in each end of the sleeve 30 as shown in FIG. 2. The end walls 22 and 24 of the shield 16 are sufficiently flexible so that they can be further spread apart from one another permitting the holes 24 to each receive a respective shaft 32 therein. The sleeve 30 is now mounted in the shield 16 and the paint roller assembly 10 is ready to use for painting in the conventional manner. After painting has been completed, a garden hose (not shown) or other water source having a threaded male end is threadably attached to the second end 44 of the hollow handle 12. When the water flows through the hollow handle 12, through the tubes 52 and out the apertures 34, water is sprayed onto the paint roller sleeve 30 diluting the paint collected on the sleeve 30. The tubes 52 provide a means for distributing the water generally evenly between the individual apertures 34 (with the exception of aperture 34*a*, which provides a stronger stream for providing s rotation to sleeve 30), for even application of the water to the sleeve 30. The streams of water expelled from each aperture 34 and particularly from the nozzle 58, obliquely strike the sleeve 30 creating a rotational force that rapidly spins the sleeve 30. By spinning the sleeve 30, a centrifugal force is applied to the water and paint solution held by the nap 68 of the sleeve 30. The constant washing with fresh water and the removal of the paint/water mixture by centrifugal force thoroughly cleans the paint roller assembly 10. The shield 16 not only prevents back splatter during the painting operation but also prevents the user from being splattered by the water/paint mixture during the cleaning process. Once the paint roller sleeve 30 is clean it may be detached from the paint roller assembly 10 and allowed to dry for future use.

It will thus be seen that the objects set forth above among those made apparent from the proceeding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A paint roller assembly comprising:

an elongate shield having an arcuate side wall and first and second opposing end walls, said shield having a plurality of apertures through said side wall;

means for mounting a paint roller sleeve being attached to each of said end walls of said shield such that said paint roller sleeve is mounted adjacent said arcuate side wall; and a distribution member comprising:

a manifold pipe connected centrally and perpendicularly to said shield, said manifold pipe having an open first end and an open second end and plurality of lateral ports formed therethrough, said open first end adapted for connecting said manifold to a fluid source under pressure, said open second end forming a nozzle extending through said sleeve; and a plurality of distribution tubes radiating outward from said manifold pipe and providing fluid communication between said manifold pipe lateral ports and said sleeve apertures, wherein each of said distribution tubes has a first end and a second end, each of said first ends communicating with said lateral ports in said manifold pipe, each of said second ends in communication with said apertures in said shield sidewall and terminating in a nozzle.

2. An assembly as in claim 1 further comprising:

a paint roller sleeve mounted to said shield, said shield being configured such that fluid passing through at least one of said nozzles strikes said sleeve tangentially.

3. An assembly as in claim 1 further comprising a handle having a longitudinal bore therethrough and having open first and second longitudinal ends, said first end of said handle being attached in fluid flow communication to said manifold and said second end of said handle further comprising means for attaching said handle to the fluid source.

4. An assembly as in claim 1 further comprising a handle having a longitudinal bore therethrough and having open first and second longitudinal ends, said first end being attached to said distribution member such that said bore of said handle is in fluid flow communication with said manifold and said means for connecting said manifold to a fluid source being attached in fluid flow communication to said second end of said handle.

* * * * *